US005235892A

United States Patent [19]

Terada et al.

[11] Patent Number: 5,235,892

[45] Date of Patent: Aug. 17, 1993

[54] CELESTA PROMPTLY RESPONSIVE TO HIGH SPEED KEYING-IN

[75] Inventors: Norishige Terada; Masaaki Takahasi; Hiroaki Ohmuro; Yasuyuki Semba, all of Shizuoka, Japan

[73] Assignee: Yamaha Corporation, Hamamatsu, Japan

[21] Appl. No.: 801,047

[22] Filed: Dec. 3, 1991

[30] Foreign Application Priority Data

Dec. 5, 1990 [JP] Japan ..... 2-405402
Mar. 28, 1991 [JP] Japan ..... 3-89449

[51] Int. Cl.[5] ..... G10D 13/08

[52] U.S. Cl. ..... 84/404; 84/237; 84/371

[58] Field of Search ..... 84/174, 236, 237, 323, 84/371, 404, 239, 240, 216, 217, 218

[56] References Cited

U.S. PATENT DOCUMENTS

| | | | |
|---|---|---|---|
| 1,664,587 | 4/1928 | Blalack et al. | 84/236 |
| 3,554,071 | 1/1971 | Klaiber | 84/236 |
| 3,857,318 | 12/1974 | Jansson et al. | 84/404 X |
| 3,981,221 | 9/1976 | Wittel | 84/404 X |

*Primary Examiner*—Michael L. Gellner
*Assistant Examiner*—P. Stanzione
*Attorney, Agent, or Firm*—Burns, Doane, Swecker & Mathis

[57] ABSTRACT

A celesta produces sounds in response to keying-in by striking sound bars with hammer units associated therewith, and key action mechanisms are provided between the keys and the hammer units, wherein the hammer units are located under the associated sound bars so that the hammers promptly return to initial positions by the aid of the gravity exerted thereon.

12 Claims, 11 Drawing Sheets

CELESTA PROMPTLY RESPONSIVE TO HIGH SPEED KEYING-IN

FIELD OF THE INVENTION

This invention relates to a celesta and, more particularly, to a key action mechanism associated with a sound bar and responsive to high-speed keying-in.

DESCRIPTION OF THE RELATED ART

A celesta is an musical instrument looking like a small piano, and produces sounds through keying-in by a player. FIG. 1 shows a typical example of the key action mechanism incorporated in the celesta, and the key action mechanism 3 is provided between a key 1 and a hammer unit 2. In detail, the key 1 is swingably supported by a balance pin 1*a*, and is engaged with the upper end of a vertical rod member 3*a* by means of a flexible joint 3*b* at the rear end thereof. The front end of the key 1 is slightly lifted, and the flexible joint 3*b* allows the rear end of the key 1 to be loose from the vertical rod member 3*a*. The vertical rod member 3*a* is further engaged at the lower end thereof with the hammer unit 2 which is rotationally supported by a bracket member 4. The bracket member is stationary with respect to a sound bar 5. The hammer unit 2 consists of a rear plate member 2*a*, a connecting rod member 2*b* and a hammer top member 2*c*, and the hammer top member 2*c* is spaced apart from the sound bar 5 by means of a spring member 3*c* as shown in FIG. 1 while the key 1 is released. Though not shown in FIG. 1, the celesta has a plurality of keys associated with the respective key action mechanisms as well as the sound bars, and cam members and link mechanisms are incorporated in several key action mechanisms, because the keys are too narrow to provide the sound bars under the associated keys.

The sound bar 5 is supported by a supporting mechanism mounted on a base member 6, and the supporting mechanism 7 is similar to those of percussion instruments. Various supporting mechanisms are disclosed and known to a person skilled in the art. One of the prior art supporting mechanisms is disclosed in Japanese utility model publication (Kokoku) No. 31-18342, and the supporting mechanism comprises protrusions upright from strings or strip members of rubber or like material, and stoppers respectively provided on the tops of the protrusions and forming bumps. The bumps are held in engagement with holes formed in sound bars, and the supporting mechanism thus arranged prevents the sound bars from production of a discord. Another supporting mechanism is disclosed in Japanese utility model publication No. 33-4343, and is implemented by elastic support members of rubber or synthetic resin. Each of the elastic support members has an engaging portion and a head portion, and is freely engaged with notches formed in the side surfaces of a sound bar. Yet another supporting mechanism is disclosed in Japanese utility model publication No. 37-822, and is implemented by pin members respectively enclosed in rubber tubes or elastic plastic tubes. The pin members are arranged in staggered manner on a frame, and are detachably engaged with sound bars. Yet another supporting mechanism is disclosed in Japanese utility model publication No. 39-10826, and is implemented by bracket members with notches. Strings are coupled between the bracket members and sound bars, and allows the sound bars to be hung.

In a performance, when the player depresses the key 1, the key 1 turns in the counter-clock-wise direction with respect to the balance pin 1*a*, and the rear end lifts the vertical rod member 3. Then, the hammer unit 2 turns in the counter-clock-wise direction against the resilient force produced by the spring member 3*c*, and strikes the sound bar 5. The string member 3*c* allows the hammer unit 2 to turn in the clock-wise direction upon release of the key 1, and the hammer top 2*c* is spaced apart from the sound bar 5 again. With the plurality of keys, the player sequentially depresses in accordance with a score, and the sequential keying-in produces a string of sounds expressing a music.

Thus, the key action mechanism 3 transfers the motion of the key 1 to the hammer unit 2, and the hammer unit 2 turns against the resilient force of the spring member 3*c* to strike the sound bar 5. However, a problem is encountered in the prior art celesta in that the hammer unit 2 is hardly responsive to quick key motions. This is because of the facts that the hammer unit 2 needs to turn against the resilient force of the spring member 3*c* and that the resilient force of the spring member moves the hammer unit 2 against the gravity exerted on the hammer unit 2.

Another problem inherent in the prior art celesta is variant key touch. As described hereinbefore, a sound bar is located directly under the associated key. However, another sound bar is sidewardly shifted from the associated key, and cam members and/or link mechanism incorporated in the associated key action mechanism transfer the key motion to the hammer unit directly over the sound bar. The cams and the link mechanisms selectively inserted are causative of the variant key touch. Moreover, the spring members 3*c* relate to the variant key touch. The spring members 3*c* are indispensable, because the hammer units 2 return to the initial position against the gravity exerted thereon. The resilient forces exerted on the respective hammer units 2 are hardly regulable, and the irregular resilient forces impress the player as variant key touch.

SUMMARY OF THE INVENTION

It is therefore an important object of the present invention to provide a celesta key mechanisms of which promptly transfer key motions with uniform key touch.

It is another important object of the present invention to provide a supporting mechanism which is applicable to the celesta according to the present invention.

To accomplish these objects, the present invention proposes to locate a sound bar above a hammer unit.

In accordance with the present invention, there is provided a celesta comprising a) a plurality of keys swingable when a player depresses, b) a plurality of sound bars respectively associated with the plurality of keys, c) a plurality of hammer units respectively associated with the plurality of sound bars for striking the associated sound bars, and located under the associated sound bars, and d) a plurality of key action mechanisms respectively coupled between the plurality of keys and the plurality of hammer units, and causing the associated hammer units to strike the associated sound bars when the associated keys swing, the plurality of key action mechanisms allowing the strike the associated sound bars when the associated keys swing, the plurality of key action mechanisms allowing the associated hammer units to return to respective initial positions by the aid of at least the gravity exerted thereon after the hammer units strike the associated sound bars.

BRIEF DESCRIPTION OF THE DRAWINGS

The features and advantages of the celesta according to the present invention will be more clearly understood from the following description taken in conjunction with the accompanying drawings in which.

DESCRIPTION OF THE PREFERRED EMBODIMENTS

First Embodiment

Figure 1:
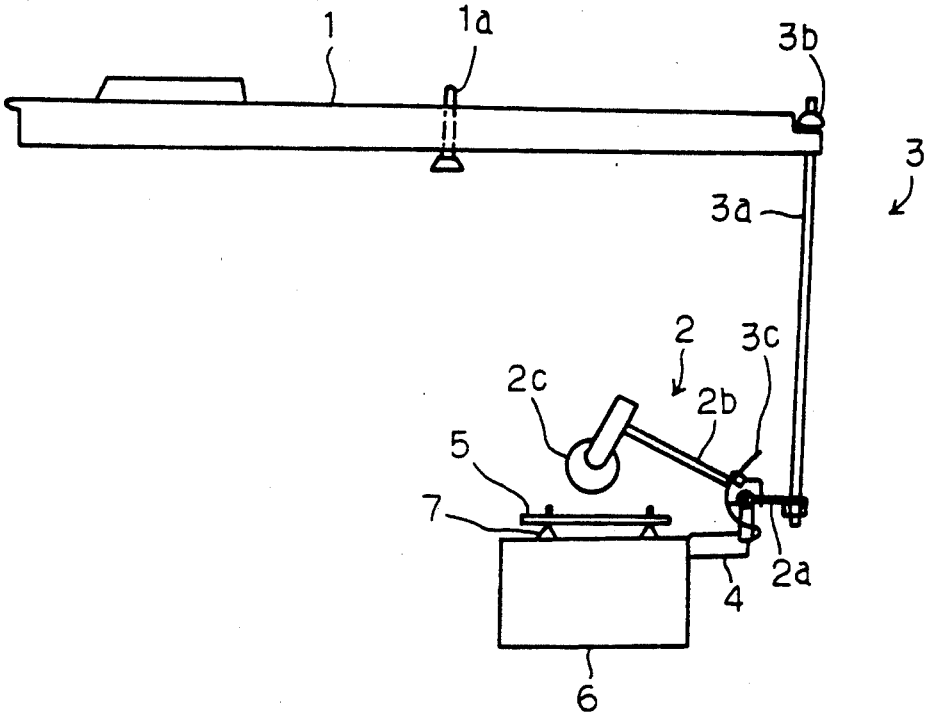
Fig. 1 PRIOR ART
FIG. 1 is a side view showing the key action mechanism incorporated in the prior art celesta.
Figure 2:
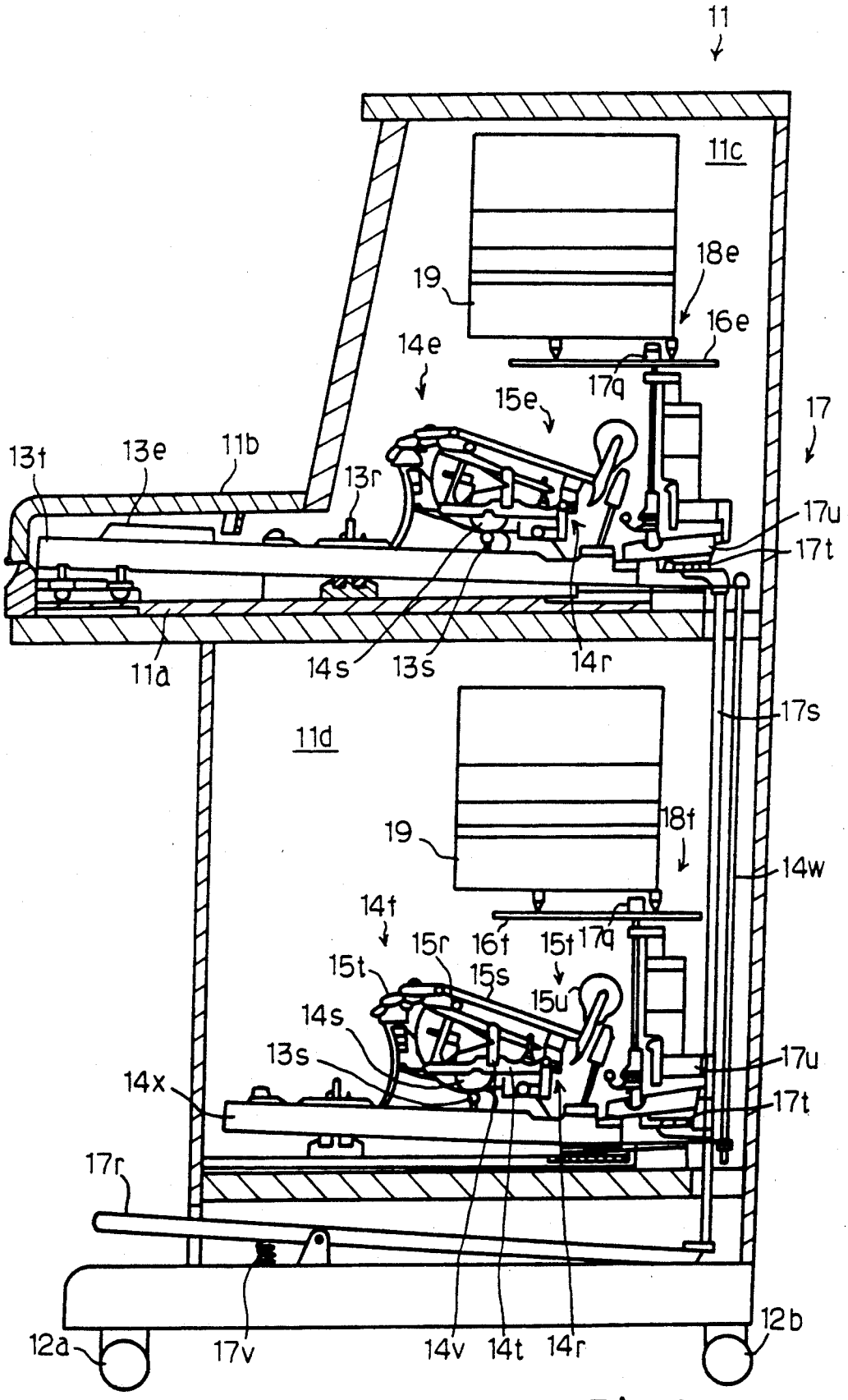
FIG. 2 is a partially cut-away side view showing the structure of a celesta according to the present invention.
Figure 3:
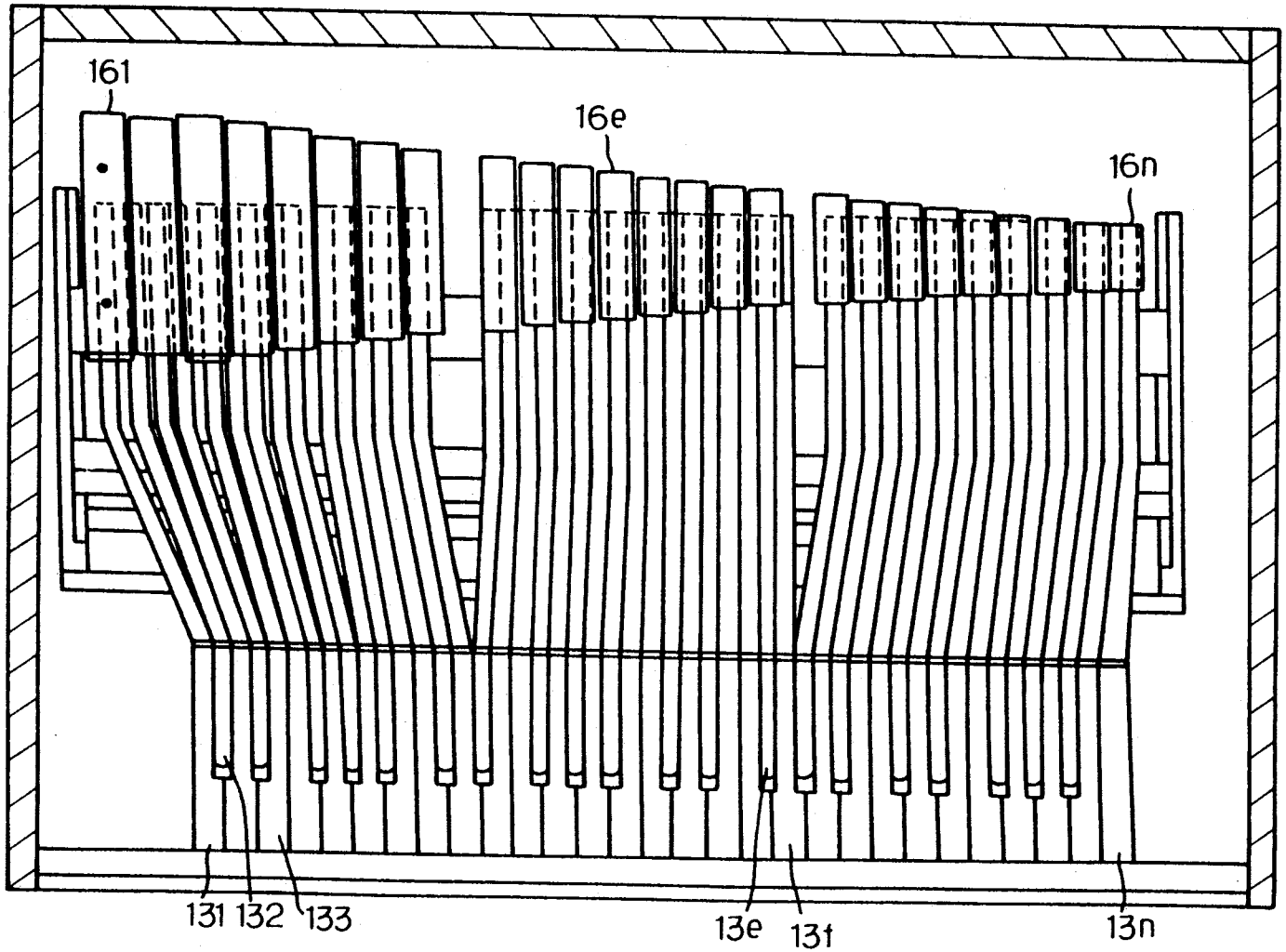
FIG. 3 is a partially cut-away plan view showing the arrangement of keys incorporated in the celesta shown in FIG. 2.
Figure 4:
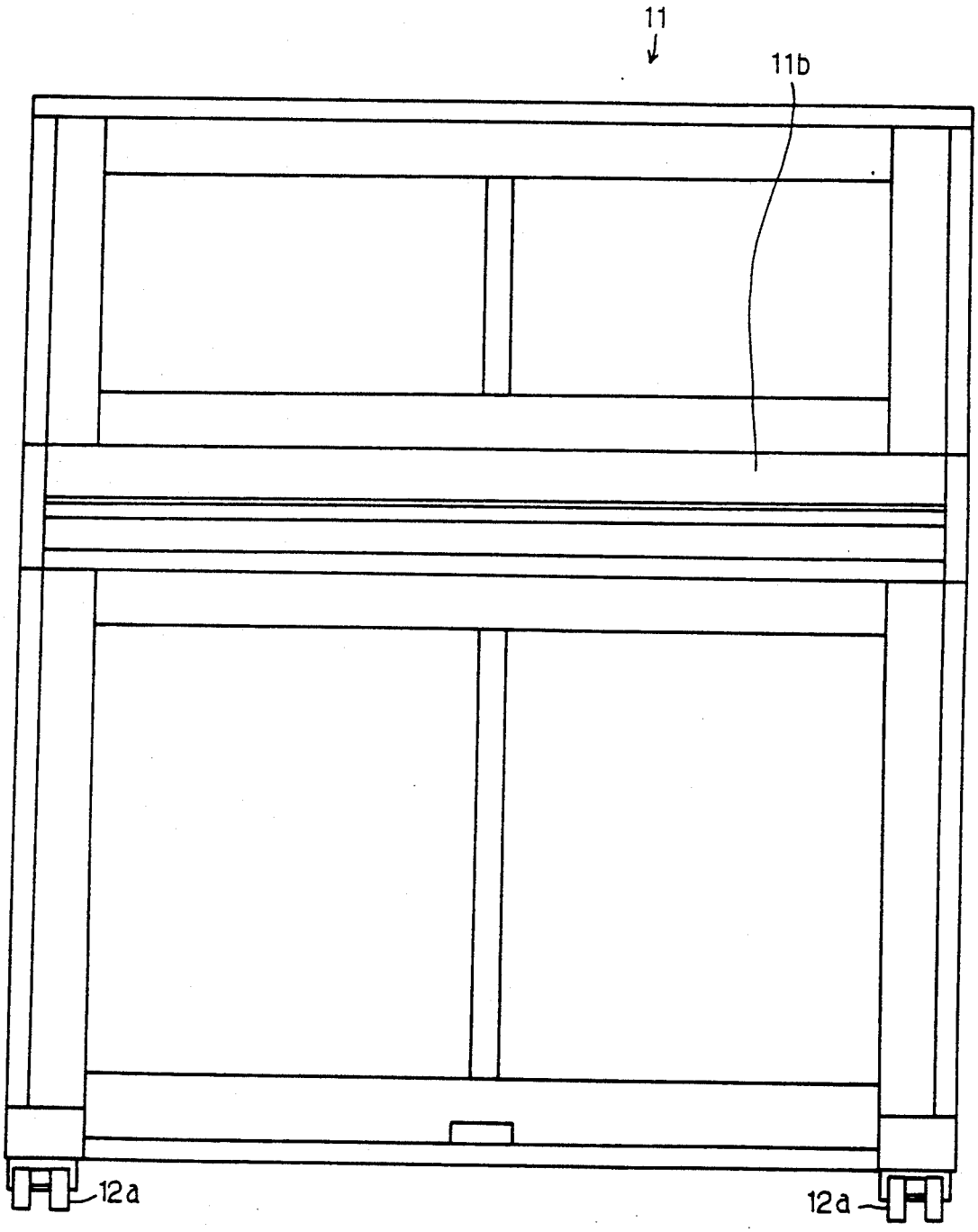
FIG. 4 is a front view showing the celesta shown in FIG. 2.

Referring to FIGS. 2 to 4 of the drawings, a celesta embodying the present invention largely comprises a case 11 movable with casters 12*a* and 12*b*, a plurality of black and white keys 131, 132, 133, 13*e*, 13*f* and 13*n* mounted on a key bed 11*a*, a plurality of key action mechanisms respectively associated with the black and white keys 131 to 13*n* for transferring key actions, hammer units respectively actuated with the key action mechanisms, and sound bars 161, 16*e*, 16*f* and 16*n* struck by the associated manner units. The case 11 has a fall board 11*b* turnable between a close position and an open position. While the fall board 11*b* is in the close position, the keys 131 to 13*n* are covered with the fall board 11*b*. However, if the fall board 11*b* turns to the open position, the keys 131 to 13*n* are exposed to a player.

The case is split into an upper section 11*c* and a lower section 11*d* by the key bed 11*a*, and the sound bars are partially accommodated in the upper section 11*c* and partially in the lower section 11*d*. The sound bars are different in size depending upon the notes assigned thereto as shown in FIG. 3, however, all of the sound bars are located over the associated hammer units.

Figure 5:
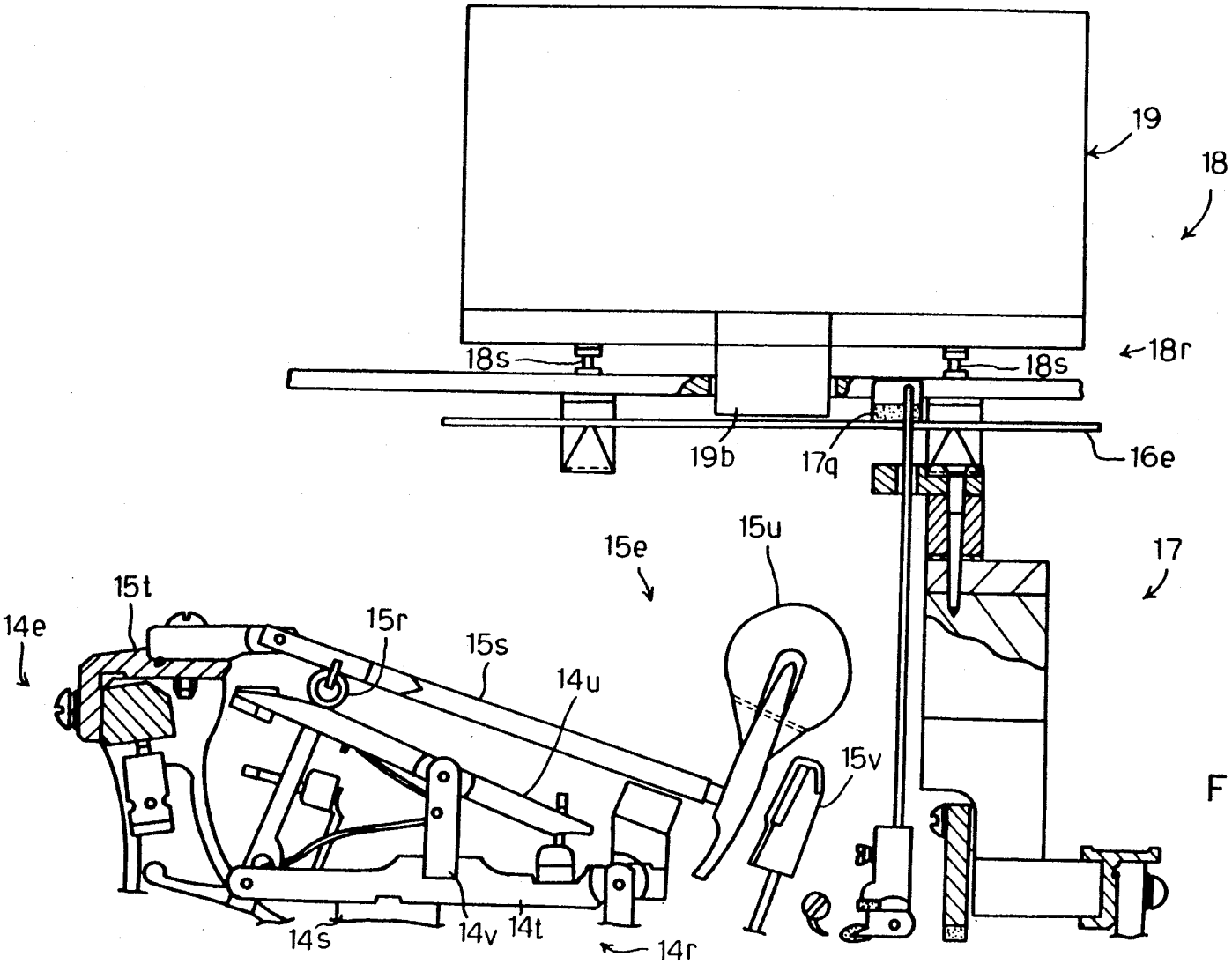
FIG. 5 is a partially cut-away side view showing, in an enlarged scale, the structure of a key action mechanism incorporated in the celesta shown in FIG. 2.

The key action mechanisms are similar to those of a ground piano, and only two key action mechanisms 14*e* and 14*f* are shown in association with the white and black keys 13*e* and 13*f* in FIG. 2. However, other key action mechanisms are deleted from the drawings for the sake of simplicity. The key action mechanisms associated with the sound bars in the upper section 11*c* are similar in structure to one another, and one of the key action mechanisms 14*e* is illustrated in an enlarged scale in FIG. 5 together with the associated hammer unit 15*e*. In detail, each of the keys 131 to 13*n* is rockable with respect to a balance pin 13*r*, and a capstan 13*s* is upwardly projected from the rear end portion of the white key 13*e* (see FIG. 2). The capstan 13*s* is held in contact with a whippen heel 14*s* of a whippen assembly 14*r*, and a whippen heel 14*s* is attached to the lower surface of the whippen 14*t*. A repetition lever 14*t* is turnably supported by repetition lever flange 14*u* attached to the whippen 14*t*, and a hammer roller 15*r* of the hammer unit 15*e* is traveled along the repetition lever 14*u*. The hammer roller 15*r* is rotationally supported by a hammer shank 15*s*, and the rear end of the hammer shank 15*s* is turnably supported by a hammer shank flange 15*t*. At the leading end of the hammer shank 15*s* is provided a hammer felt 15*u* which strikes the sound bar 16*e* upon depressing the white key 13*e*. A hammer felt 15*v* is provided in association with the hammer felt 15*u*. The capstain 13*s*, the whippen heel 14*s*, the whippen 14*t*, the repetition flange 14*v* and the repetition lever 14*u* form parts of the key action mechanism 14*e*, and the hammer roller 15*r*, the hammer shank 15*s*, the hammer shank flange 15*t* and the hammer felt 15*u* constitute the hammer unit 15*e*. When the player depresses the white key 13*e*, the key action mechanism 14*e* actuates the hammer unit 15*e*, and the hammer felt 15*u* strikes the lower surface of the sound bar 16*e*.

The key action mechanisms associated with the sound bars in the lower section are similar to those in the upper section 11*c* except for connecting rods and rockable bars 14*x*. For example, the key action mechanism 14*f* contains all the components corresponding to those of the key action mechanism 14*e* labeled with the same references, and further comprises a connecting rod 14*w* engaged at the upper end thereof with the rear end of the black key 13*f* and at the lower end thereof with a rockable bar 14*x*. A capstan 13*s* of the key action mechanism 14*f* is implanted in the rockable bar 14*x*, and the other components 14*t*, 14*u* and 14*v* of the key action mechanism 14*f* as well as the components 15*r*, 15*s*, 15*t* and 15*u* of the hammer unit 15*f* are assembled on the rockable bar 14*x*. When the player depresses the black key 13*f*, the connecting rod 14*w* transfers the key motion to the rockable bar 14*x*, and the hammer felt 15*u* strikes the sound bar 16*f* as similar to the hammer felt 15*u* of the hammer unit 15*e*.

A damper mechanism 17 is provided in association with the sound bars, and damper felts 17*q* are linked with a damper pedal 17r through a pedal rod 17s, lifting rails 17t, damper levers 17u. If the player presses the damper pedal 17r against a coil spring 17v, the pedal rod 17s causes the lifting rails 17t and the damper levers 17u to turn so that the damper felts 17q are left from the upper surfaces of the associated sound bars. The damper mechanism 17 allows the player to impart various musical expression to sounds.

Figure 6:
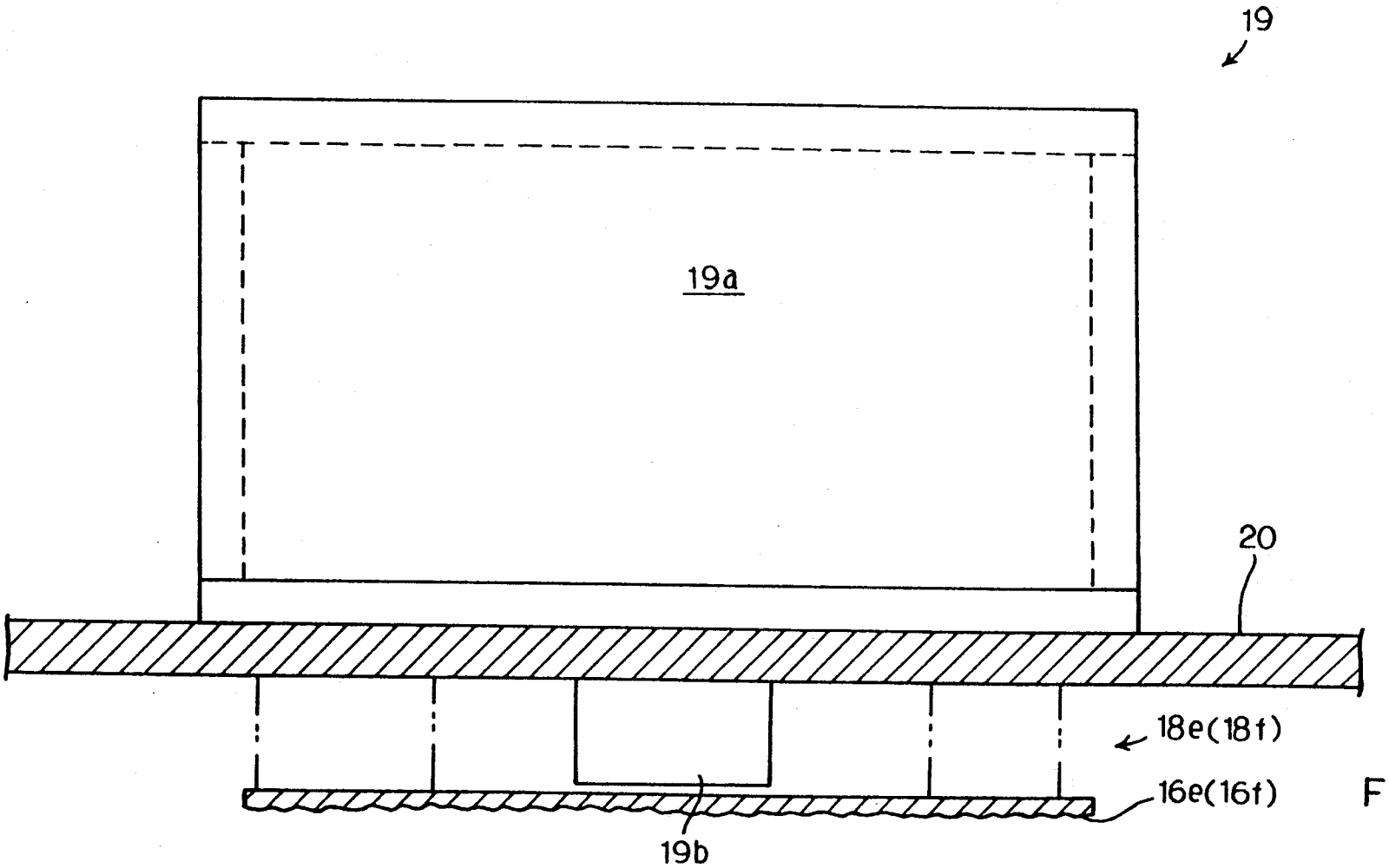
FIG. 6 is a partially cut-away side view showing a resonance box incorporated in the celesta shown in FIG. 2.

The sound bars are respectively supported by supporting mechanisms appropriate thereto, and the supporting mechanisms in turn are supported by the case 11 together with resonance boxes 19. The resonance boxes 19 are of the Helmholtz resonator having an inner space 19a and an inlet 19b. shown in FIG. 6. A beam 20 supports the resonance boxes and the supporting mechanisms, and is fixed to the case 11.

In FIG. 2, only two supporting mechanisms 18e and 18f are shown in association with the sound bars 16e and 16f, respectively, and the inlet 19b of the associated resonance box 19 is spaced apart from the upper surface of the sound bar 16e or 16f by, for example, 5 millimeters. The space between the inlet 19b and the sound bar 16e or 16f is variable, and an adjusting mechanism 18r of the supporting mechanism 18e or 18f is provided between the resonance box 19 and the sound bar as will be seen from FIG. 5. The space between the resonance box 19 and the sound bar 16e or 16f ranges from 2 millimeters to 10 millimeters, and is dependent upon room temperature and humidity.

In performance, the player sequentially depresses the keys 131 to 13n, and the key action mechanisms actuate the associated hammer units so that the hammer units sequentially strike the associated sound bars. The hammer units return to initial positions shown in FIG. 2 upon striking by the aid of the gravity exerted thereon. Since any cam member and any spring are not incorporated in the key action mechanisms, the player enjoys uniform key touch and, accordingly, feels comfortable. Moreover, after striking the associated sound bar, the associated hammer unit promptly returns to the initial position, because the gravity assists. This results in that the celesta according to the present invention is responsive to high-speed keying-in, and the celesta according to the present invention is desirable for music of posromanticism.

Second Embodiment

Figure 7:
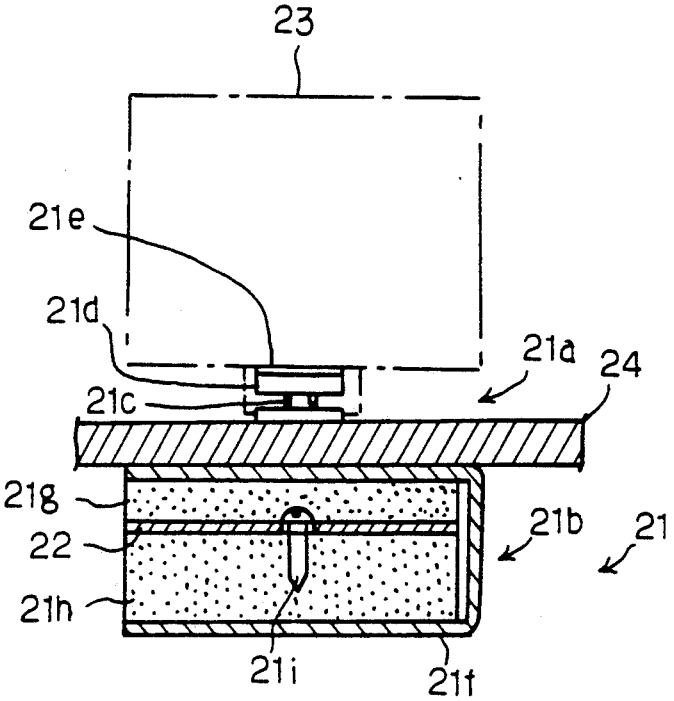
FIG. 7 is a sectional view showing the structure of a supporting mechanism incorporated in another celesta according to the present invention.
Figure 8:
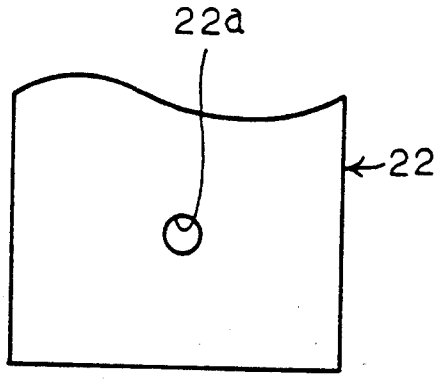
FIG. 8 is a plan view showing a sound bar incorporated in the celesta shown in FIG. 7.

Turning to FIG. 7 of the drawings, an essential part of a supporting mechanism 21 couples one of sound bars 22 as well as one of resonance boxes with a supporting beam 24, and the supporting beam 24 is fixed to a case (not shown). Other components such as keys, key action mechanisms, hummer units and a damper mechanism are similar to those of the first embodiment, and no further description is incorporated hereinbelow for the sake of simplicity.

The supporting mechanism 21 comprises an adjusting mechanism 21a for the resonance box 23 and a holder 21b for the sound bar 22. The adjusting mechanism 21a comprises a screw stud 21c projecting from the upper surface of the supporting beam 24, and a nut 21d. The screw stud 21c is screwed into the resonance box 23, and the nut 21d with a spacer member 21e is pressed against the resonance box 23. Since the screw stud 21c is appropriately screwed into the resonance box 23 before press against the resonance box 23, the gap between the resonance box 23 and the sound bar 22 is adjustable.

The holder 21b comprises bracket member 21f, an upper felt 21g with a generally rectangular cross section, a lower felt 21h with a wedge-shaped cross section, and a screw 21i. Since a loose hole 22a is formed in the sound bar 22, the screw 21i passes through the loose hole 22a, and fixes the sound bar 22 to the lower felt 21h, thereby restricting lateral movement of the sound bar 22 with respect to the lower felt 21h. The sound bar 22 is sandwiched between the upper and lower felts 21g and 21h, and are inserted into the bracket member 21f. Then, the sound bar 22 is held by the bracket member 21f, and is, accordingly, supported by the supporting beam 24.

Third Embodiment

Figure 9:
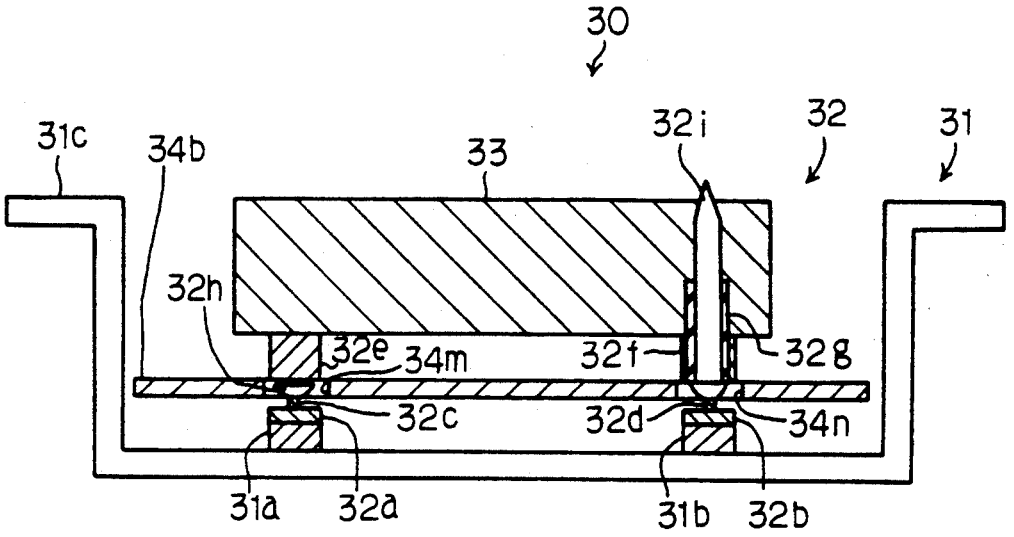
FIG. 9 is a cross sectional view showing the structure of a supporting mechanism incorporated in yet another celesta according to the present invention.
Figure 10:
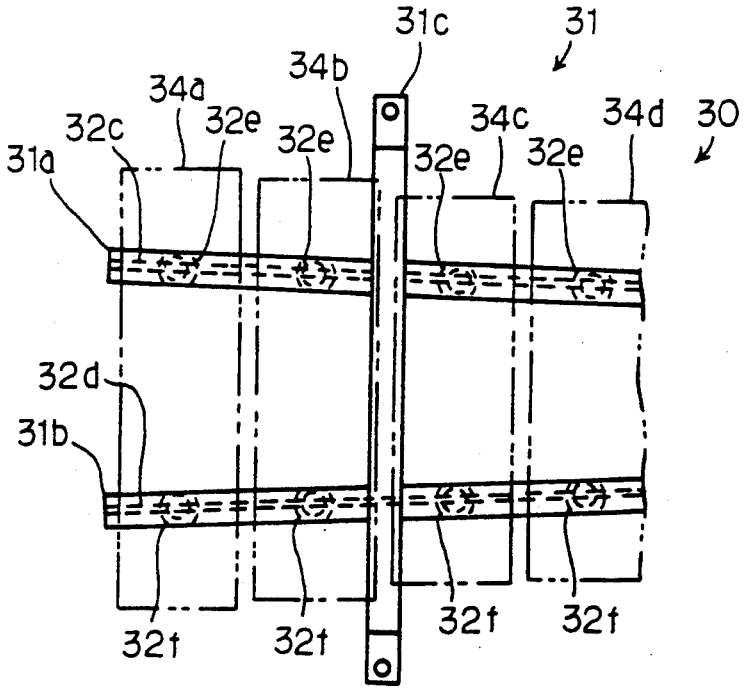
FIG. 10 is a plan view showing the structure of a frame incorporated in the supporting mechanism shown in FIG. 9.

Turning to FIGS. 9 and 10 of the drawings, one of the supporting mechanisms 30 incorporated in yet another celesta is illustrated. The celesta implementing the third embodiment is similar in arrangement to the first embodiment except for the supporting mechanisms 30, and, for this reason, no further description is incorporated hereinbelow for the sake of simplicity. The supporting mechanism 30 largely comprises a frame 31, a damper 32, and a base member 33. The frame 31 is shared between a plurality of sound bars 34a, 34b, 34c and 34d, and comprises lateral beams 31a and 31b and bracket members 31c provided at spacings and crossing the lateral beams 31a and 31b at right angle. In this instance, the frame 31 is formed of wood. However, metal or synthetic resin is available for the frame 31. Although only one of the bracket members 31c is shown in FIGS. 9 and 10, the bracket members 31c are connected with juxtaposed main beams (not shown).

Felt sheets 32a and 32b adhere the upper surfaces of the lateral beams 31a and 31b, and strings 32c and 32d extend over the felt sheets 32a and 32b. The sound bars 34a to 34d are placed on the strings 32c and 32d in such a manner as to bridge over the gap between the strings 32c and 32d. The sound bars 34a to 34d are formed of, for example, metal, wood, synthetic resin or ceramic.

A pair of tubular members 32e and 32f of felt are provided in association with the base member 33, and a rubber tube 32g is inserted into each of the tubular members 32e and 32f. A pair of pins 32h and 32i pass through the rubber tubes 32g, and fix the rubber tubes 32g and, accordingly, the tubular members 32e and 32f to the base member 33. A pair of holes 34m and 34n are formed in each of the sound bars 34a to 34d, and the heads of the pins 32h and 32i are held in engagement with the strings 32c and 32d through the holes 34m and 34n. The rubber tubes 32g as well as the tubular members 32e and 32f of felt prevent the pins 32h and 32i from direct contact with the associated sound bar. Since the heads of the pins 32h and 32i remain inside the holes 34m and 34n at all times, the sound bars 34a to 34d hardly move laterally while the associated sound bars 34a to 34d vibrate. Moreover, by virtue of the felt sheets 32a and 32b and the tubular members 32e and 32f, the sound bars 34a to 34d are hardly movable in the vertical direction. The holes 34m and 34n are located at predetermined positions where nodes of vibrations takes place upon striking the sound bar. The locations of the holes 34m and 34n are advantageous in view of free oscillation. Namely, when a hammer unit (not shown) strikes the lower surface of one of the sound bars 34a to 34d, the sound bar is slightly lifted, and the tubular members 32e and 32f attached to the base member 33 restrict the sound bar. The sound bar vibrates and is landed on the strings 32c and 32d. However, the heads of the pins 32h and 32i are contact with the strings 32c and 32d, and the holes 34m and 34n and, accordingly, the heads of the pins 32h and 32i are at the nodes of the vibrations. Therefore, the vibrations of the sound bar are hardly decayed, and are allowed to continue. In this instance, the felt sheets 32a and 32b, the strings 32c and 32d, the tubular members of felt 32e and 32f and the rubber tubes 32g as a whole constitute the damper 32.

The supporting mechanism 30 incorporated in the third embodiment is reversible. Even if the structure shown in FIG. 9 is turned at 180 degrees so as to locate the base member 33 under the sound bars 34a to 34d, the damper 32 effectively restricts the sound bars 34a to 34d, and the sound bars 34a to 34d freely vibrate. In detail, when the hammer unit strikes the lower surface of one of the sound bars 34a to 34d, the strings 32c and 32d and, accordingly, the felt sheets 32a and 32b take up the vertical movement of the sound bar. Thereafter, the strings 32c and 32d continue to support the weight of the sound bar, and the locations of the holes 34m and 34n and, accordingly, the heads of the pins 32h and 32i allow the sound bars 34a to 34d to freely vibrate. Thus, the supporting mechanisms 30 of the third embodiment is reversible, and enhances the space utility. The reversible supporting mechanisms 30 allow a hammer to strike downwardly, and are widely applicable to percussion instruments.

Additionally, the damper 32 may be constituted by some resilient members selected from the components of the damper 32 incorporated in the third embodiment.

Figure 11:
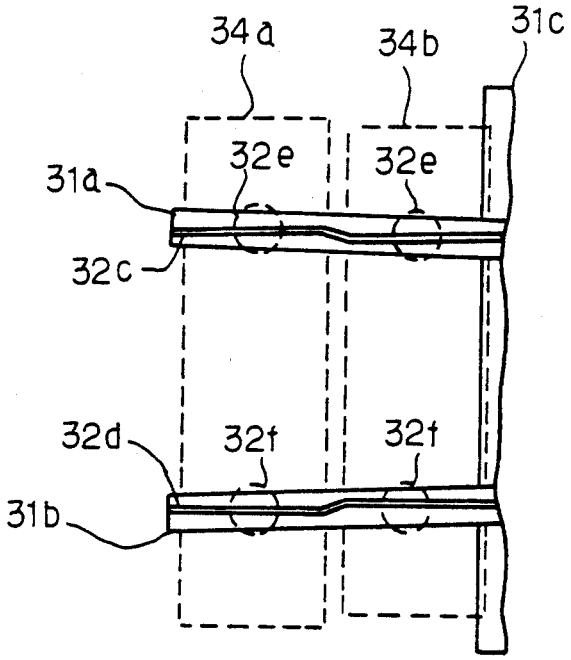
FIG. 11 is a plan view showing another arrangement of strings forming a part of the supporting mechanism shown in FIG. 9.

In the supporting mechanisms 30 shown in FIG. 9, the strings 32c and 32d are straight along the felt sheets 32a and 32b. However, the strings 32c and 32d trace zig-zag courses on the felt sheets 32a and 32b as shown in FIG. 11. The zig-zag courses allow the strings 32c and 32d to exactly pass through the areas where the heads of the pins 32h and 32i are brought into contact.

Fourth Embodiment

Figure 12:
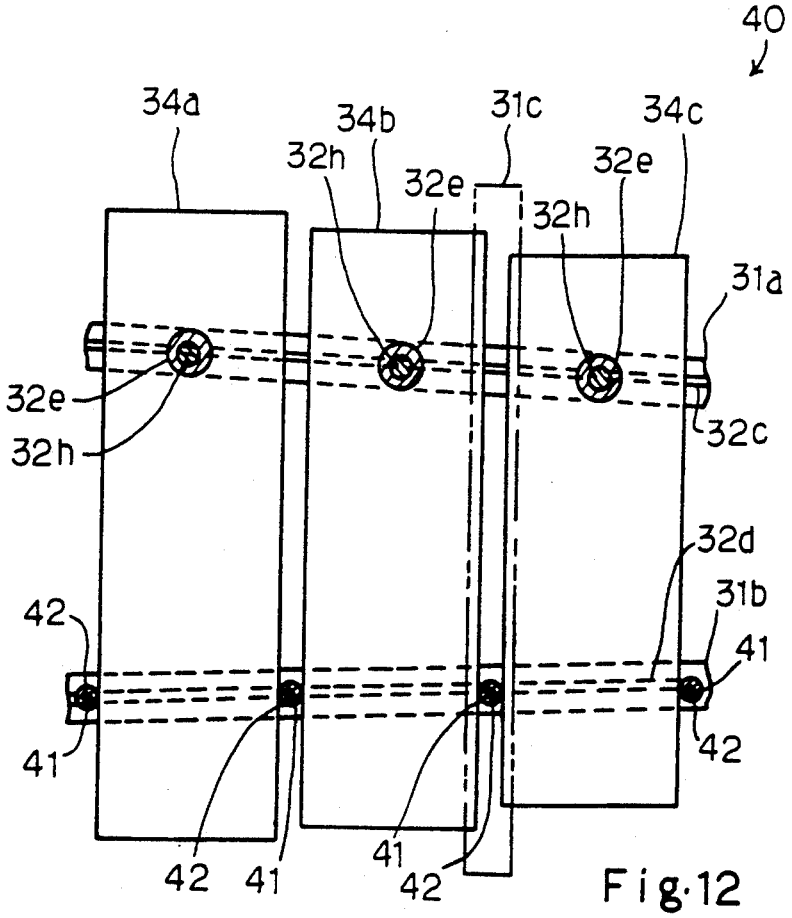
FIG. 12 is a plan view showing a supporting mechanism incorporated in yet another celesta according to the present invention.

Turning to FIG. 12 of the drawings, a supporting mechanism 40 incorporated in yet another celesta is illustrated. However, the other components of the celesta implementing the fourth embodiment are similar to those of the first embodiment, and detailed description is omitted for avoiding repetition. One of the differences between the supporting mechanisms 30 and 40 of the third and fourth embodiments is directed to pins 41 respectively enclosed by rubber tubes 42 and projecting from the lateral beams 31b at spacings. The pins 41 are located between every two adjacent sound bars 34a to 34c. and space the sound bars from the adjacent sound bars. Therefore, each of the sound bars 34a to 34c has a single hole allowing the tubular member 32e and the pin 32h to pass on the opposite side to the pin 41. The behavior of the supporting mechanism 40 is similar to that of the third embodiment, and no further description is incorporated hereinbelow for avoiding repetition.

Fifth Embodiment

Figure 13:
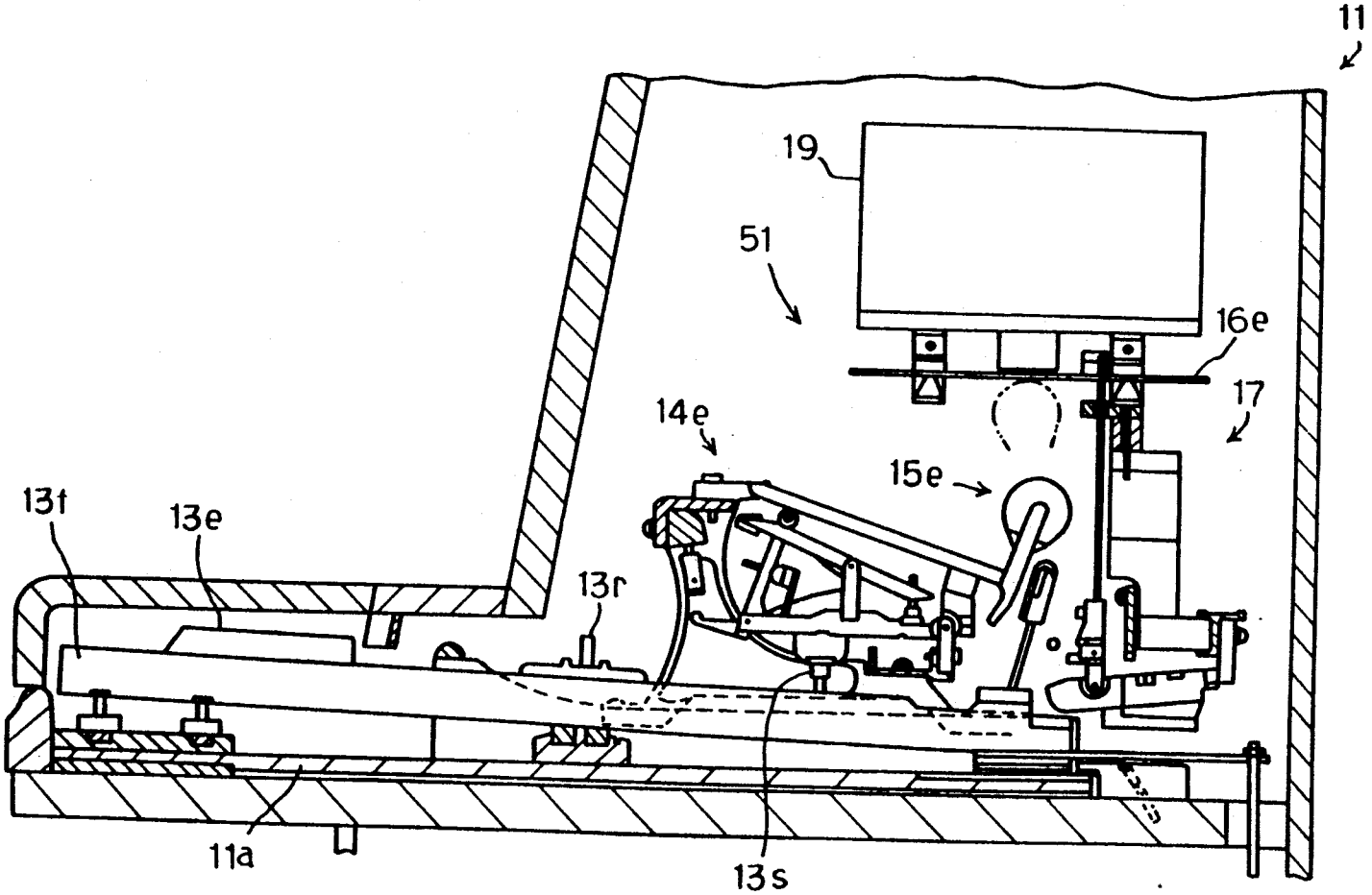
FIG. 13 is a cross sectional view showing the structure of yet another celesta according to the present invention.

Turning to FIG. 13 of the drawings, yet another celesta embodying the present invention is illustrated. The celesta implementing the fifth embodiment is equipped with another supporting mechanism 51. However, the other components are similar to those of the first embodiment, and are labeled with the same references without detailed description.

Figure 14:
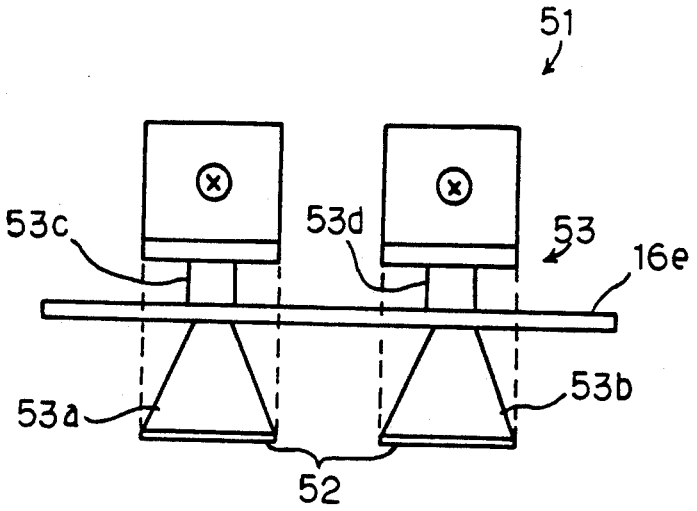
FIG. 14 is a partially cut-away front view showing a supporting mechanism incorporated in the celesta shown in FIG. 13.
Figure 15:
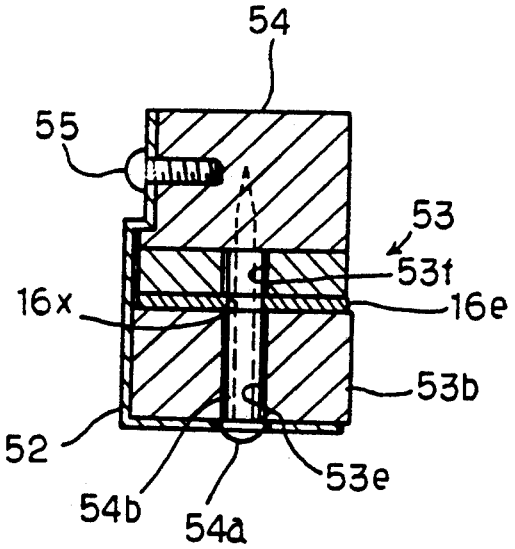
FIG. 15 is a cross sectional view showing the structure of the supporting mechanism shown in FIG. 14.
Figure 16:
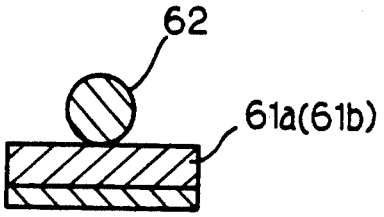
FIG. 16 is a cross sectional view showing a modification of a part of the supporting mechanism shown in FIG. 14.

Turning to FIGS. 14 and 15, the supporting mechanism 51 largely comprises a frame 52, a damper 53 and a base member 54. The frame 52 has a generally L-shaped cross section, and mounts wedge-shaped felt members 53a and 53b. The sound bar 16e is sandwiched between the wedge-shaped felt members 53a and 53b and box-shaped felt members 53c and 53d, and felt members 53a to 53c are formed with holes 53e and 53f. Holes 16x are also formed in the sound bar 16e, and holes 16x of the sound bar 16e are located at those spots where nodes of vibrations take place upon striking. Pins 54a are covered with, for example, felt tubes 54b, respectively, and the felt tubes 54b are accommodated in the holes 53e, 16x and 53f. The leading ends of the pins 54a project into the base members 54, and the base members 54 are fixed to the frames 52 by means of bolts 55. Therefore, the damper 53 and, accordingly, the sound bar 16x are supported by the frame 52, and the locations of the holes 16x allow the sound bar 16e to freely vibrate. In this instance, the felt members 53a to 53d form in combination the damper 53. Since the felt members 53a and 53b have the wedge-shape, the felt members 53a and 53b are held in contact with the sound bar 16e at small areas, and allow the sound bar 16e to freely vibrate.

The felt members 53a and 53b are replaceable with felt sheets 61a and 61b adhered to the frame 52 and a string 62 adhered to the felt sheets 61a and 61b.

Although particular embodiments of the present invention have been shown and described, it will be obvious to those skilled in the art that various changes and modifications may be made without departing from the spirit and scope of the present invention. For example, each of the supporting mechanisms incorporated in the celesta according to the present invention may be applicable for any percussion instrument such as a vibraphone.

What is claimed is:

1. A celesta comprising a) a plurality of keys, each of said plurality of keys being swingable when selectively depressed by a player;

b) a plurality of sound bars respectively associated with said plurality of keys;

c) a plurality of hammer units respectively associated with said plurality of sound bars for striking said associated sound bars, and located under said associated sound bars;

d) a plurality of key action mechanisms respectively coupled between said plurality of keys and said plurality of hammer units, and causing said associated hammer units to strike said associated sound bars when said associated keys swing, said plurality of key action mechanisms allowing said associated hammer units to return to respective initial positions by the aid of at least the gravity exerted thereon after said associated hammer units strike said associated sound bars; and e) a plurality of resonance boxes provided in association with said plurality of sound bars, respectively, an adjusting mechanism being provided between each of said plurality of resonance boxes and each of said plurality of sound bars for adjusting a gap therebetween.

2. A celesta as set forth in claim 1, in which said plurality of keys are provided on a flat surface and broken down into first and second key groups, and in which said plurality of sound bars are partially provided in an upper section over said plurality of keys and partially in a lower section under said plurality of keys, said plurality of key action mechanisms selectively coupling said plurality of keys with said hammers associated with said sound bars over said plurality of keys and with said hammers associated with said sound bars under said plurality of keys.

3. A celesta as set forth in claim 2, in which said key action mechanisms are broken down into a first group provided for said keys associated with said sound bars in said upper section and a second group provided for said keys associated with said sound bars in said lower section, in which each of said key action mechanisms of said first group comprises a whippen assembly provided between said associated key and said associated hammer unit, wherein each of said key action mechanisms of said second group comprises a connecting rod engaged with said associated key, a rockable bar engaged with said connecting rod and a whippen assembly provided between said rockable bar and said associated hammer unit.

4. A celesta as set forth in claim 3, in which said celesta further comprises:

a damper mechanism associated with said sound bars.

5. A celesta as set forth in claim 1, in which said celesta further comprises g) a plurality of supporting mechanisms respectively associated with said plurality of sound bars for locating said sound bars over said associated hammer mechanisms, respectively.

6. A celesta as set forth in claim 5, in which each of said supporting mechanisms comprises a rigid frame, a damper provided between said rigid frame and the associated sound bar, and at least two pin members passing through at least two holes formed in said associated sound bar and fixing said associated sound bar and said damper to said rigid frame, said at least two holes of said associated sound bar being located in such a manner that nodes of vibrations take place thereat upon striking with said associated hammer unit.

7. A celesta as set forth in claim 6, in which said at least two pin members are covered with a substance capable of insulating vibrations.

8. A celesta as set forth in claim 5, in which each of said supporting mechanisms comprises a rigid frame, a damper provided between said rigid frame and the associated sound bar, a first pin member passing through a first hole formed in said associated sound bar and fixing said associated sound bar and said damper to said rigid frame, and a second pin member fixed to said rigid frame and attached to a predetermined side area of said associated sound bar for spacing said associated sound bar from an adjacent sound bar, said first and second pin members being located in the vicinity of those spots where nodes of vibrations take place thereat upon striking said associated sound bar with said associated hammer unit.

9. A celesta as set forth in claim 5, in which each of said supporting mechanisms comprises a rigid frame, a pair of generally wedge-shaped lower felt members mounted on said rigid frame, a pair of upper felt members sandwiching said associated sound bar together with said generally wedge-shaped lower felt members, a base member mounted on said upper felt members, and pin members passing through holes of said generally wedge-shaped lower felt members, holes of said associated sound bar and holes of said upper felt members for fixing to said rigid frame, said holes of said associated sound bar being spaced apart from each other so that nodes of vibrations take place thereat.

10. A celesta comprising a) a plurality of keys, each of said plurality of keys being swingable when selectively depressed by a player;

b) a plurality of sound bars respectively associated with said plurality of keys;

c) a plurality of hammer units respectively associated with said plurality of sound bars for striking said associated sound bars, and located under said associated sound bars;

d) a plurality of key action mechanisms respectively coupled between said plurality of keys and said plurality of hammer units, and causing said associated hammer units to strike said associated sound bars when said associated keys swing, said plurality of key action mechanisms allowing said associated hammer units to return to respective initial positions by the aid of at least the gravity exerted thereon after said associated hammer units strike said associated sound bars; and e) a plurality of resonance boxes provided in association with said plurality of sound bars, respectively.

11. A celesta as set forth in claim 10, in which said celesta further comprises:

an adjusting mechanism provided between each of the plurality of resonance boxes and each of the plurality of sound bars for adjusting a gap therebetween.

12. A celesta as set forth in claim 10, in which said key action mechanisms are broken down into a first group provided for said keys associated with said sound bars in said upper section and a second group provided for said keys associated with said sound bars in said lower section, in which each of said key action mechanisms of said first group comprises a whippen assembly provided between said associated key and said associated hammer unit, wherein each of said key action mechanisms of said second group comprises a connecting rod engaged with said associated key, a rockable bar engaged with said connecting rod and a whippen assembly provided between said rockable bar and said associated hammer unit.

* * * * *